US009601253B2

(12) United States Patent
Yokoyama et al.

(10) Patent No.: US 9,601,253 B2
(45) Date of Patent: Mar. 21, 2017

(54) LAMINATED-TYPE INDUCTANCE DEVICE

(71) Applicant: Murata Manufacturing Co., Ltd., Kyoto (JP)

(72) Inventors: Tomoya Yokoyama, Kyoto (JP); Shigetoshi Hayashi, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 0 days.

(21) Appl. No.: 14/672,774

(22) Filed: Mar. 30, 2015

(65) Prior Publication Data

US 2015/0206643 A1 Jul. 23, 2015

Related U.S. Application Data

(63) Continuation of application No. PCT/JP2013/069587, filed on Jul. 19, 2013.

(30) Foreign Application Priority Data

Nov. 1, 2012 (JP) ..... 2012-242156

(51) Int. Cl.
*H01F 17/04* (2006.01)
*H01F 5/00* (2006.01)
(Continued)

(52) U.S. Cl.
CPC ..... *H01F 17/0013* (2013.01); *H01F 3/14* (2013.01); *H01F 17/04* (2013.01)

(58) Field of Classification Search
CPC .... H01F 17/0013; H01F 3/14; H01F 27/2804; H01F 2027/2809
(Continued)

(56) References Cited

U.S. PATENT DOCUMENTS 6,459,351 B1 * 10/2002 Maki ..... H01F 27/2804 336/200
6,882,261 B2 * 4/2005 Moro ..... H01F 27/027 336/200
(Continued)

FOREIGN PATENT DOCUMENTS

CN 102057452 A 5/2011
CN 102473504 A 5/2012
(Continued)

OTHER PUBLICATIONS

International Search Report issued in Application No. PCT/JP2013/069587 dated Sep. 10, 2013.
Translation of Written Opinion issued in Application No. PCT/JP2013/069587 dated Sep. 10, 2013.
Notice of the First Office Action issued in Chinese Patent Application No. 201380055213 dated May 30, 2015.

*Primary Examiner* — Elvin G Enad
*Assistant Examiner* — Kazi Hossain
(74) *Attorney, Agent, or Firm* — Pearne & Gordon LLP

(57) ABSTRACT

Provided is a laminated-type inductance device capable of reducing the number of layers for sandwiching a non-magnetic body layer and enhancing direct-current superposition characteristics without intentionally providing a space. In a conductive pattern, portions of the outer circumferential section thereof adjacent to end surface electrodes are respectively recessed toward the inside of the pattern when viewed from above. In other words, line widths are narrower at the above portions. Further, non-magnetic paste is formed between the end surface electrode and the outer circumferential section of the conductive pattern at each of the portions where the line width is narrower. By applying the non-negative paste in a space between the conductive pattern and the end surface electrode, the portion where the non-magnetic paste is applied has the same function as in a case where the non-magnetic ferrite layer is inserted therein.

6 Claims, 3 Drawing Sheets

(51) Int. Cl.
*H01F 27/28* (2006.01)
*H01F 27/24* (2006.01)
*H01F 17/00* (2006.01)
*H01F 3/14* (2006.01)

(58) Field of Classification Search
USPC ..... 336/221, 200, 232, 234, 83
See application file for complete search history.

(56) References Cited

U.S. PATENT DOCUMENTS 7,719,398 B2 * 5/2010 Tsuzuki ..... H01F 17/0013 336/200
7,944,336 B2 * 5/2011 Mizuno ..... H01F 17/0013 29/605
2011/0074537 A1 * 3/2011 Nakatsuji ..... H01F 17/0013 336/200
2011/0133881 A1 * 6/2011 Nakajima ..... H01F 3/14 336/200
2012/0286917 A1 11/2012 Uchida

FOREIGN PATENT DOCUMENTS

| | | | |
|---|---|---|---|
| JP | H04-65807 | A | 3/1992 |
| JP | 2000-182834 | A | 6/2000 |
| JP | 2007-281379 | A | 10/2007 |
| JP | 2011-091269 | A | 5/2011 |
| WO | 2009/150921 | A1 | 12/2009 |
| WO | 2010/150602 | A1 | 12/2010 |
| WO | 2012/140805 | A1 | 10/2012 |
| WO | 2012/144103 | A1 | 10/2012 |

* cited by examiner

LAMINATED-TYPE INDUCTANCE DEVICE

BACKGROUND OF THE INVENTION

Field of the Invention

The present disclosure relates to laminated-type inductance devices structured by laminating a plurality of ceramic green sheets in which a conductive pattern is formed.

Background Art

Laminated-type inductance devices structured by laminating ceramic green sheets made of magnetic body material in which a conductive pattern is printed, have been well-known.

A large inductance value is required in the case where a laminated-type inductance device is used for a choke coil of a DC-DC converter or the like. In addition, a low direct-current resistance component and excellent direct-current superposition characteristics are required.

In order to suppress an inductance value from decreasing in a region where a load current is small in size, it is desirable to relax stress that is generated due to a difference in thermal expansion coefficient between a magnetic body/non-magnetic body and an electrode material. As such, providing a space inside a multilayer body is proposed (for example, see Patent Document 1).

In order to lower a direct-current resistance component, it can be thought to widen a line width of a conductive pattern, thicken a thickness thereof, or the like. However, widening the line width consequently needs a larger area. Accordingly, it is preferable to thicken the thickness when a limited mounting area being considered.

Further, in order to obtain excellent direct-current superposition characteristics, it can be thought to provide a non-magnetic body layer to be sandwiched inside a multilayer substrate (for example, see Patent Document 2).

Patent Document 1: Japanese Unexamined Patent Application Publication No. 4-65807

Patent Document 2: Japanese Unexamined Patent Application Publication No. 2000-182834

BRIEF SUMMARY OF THE INVENTION

However, in the case where the thickness of the conductive pattern is made thicker, carbon paste, for example, is provided on the conductive pattern so as to provide a space for relaxing the stress, or the like, a step is generated due to different thicknesses among the conductive pattern, a material used for providing the space, and so on when laminating magnetic body substrates. As such, pressure is unlikely to be applied to the vicinity of an edge of the conductive pattern when performing pressure bonding. Accordingly, a delamination in which the conductive pattern is peeled from ceramics can occur after firing.

In the case of a non-magnetic body layer being sandwiched, ceramic green sheets made of a non-magnetic body need be provided. This raises a problem that the thickness of the overall multilayer substrate increases. Further, in the case where a non-magnetic body layer which is large in quantity is sandwiched, there arises a problem that an inductance value is excessively lowered in a region where a load current is small in size.

As such, the present disclosure provides a laminated-type inductance device that is capable of reducing the number of layers for sandwiching a non-magnetic body layer and enhancing direct-current superposition characteristics.

A laminated-type inductance device according to the present disclosure includes a magnetic body layer formed of a plurality of magnetic body substrates being laminated, a non-magnetic body layer formed of a plurality of non-magnetic body substrates being laminated and disposed in the outermost layer, and an inductor in which a coil provided among the laminated substrates is connected in a laminating direction. Further, the laminated-type inductance device is characterized in that a non-magnetic body is formed between an end surface electrode provided on an end surface of a main body of the device and an outer circumferential section of the coil in the magnetic body layer.

As described above, applying a non-magnetic body (non-magnetic paste) in a space between the outer circumferential section of the coil and the end surface electrode allows a portion where the non-magnetic paste is applied to have the same function as in a case where a non-magnetic ferrite layer is provided to be sandwiched therein. Accordingly, a non-magnetic ferrite layer need not be additionally provided to be sandwiched, and thus the direct-current superposition characteristics can be enhanced. In addition, because magnetic resistance can be changed by changing the number of layers where the non-magnetic paste is applied, the direct-current superposition characteristics to serve as an inductor can be controlled. Further, because the non-magnetic paste consequently removes a step generated in an area between the outer circumferential section of the coil and the end surface electrode, pressure is also applied to the above area when performing pressure bonding, thereby making it possible to suppress the occurrence of delamination.

It is preferable that a line width of a portion of the coil adjacent to the end surface electrode be narrower than a line width of the other portion thereof, and the non-magnetic body be formed between the end surface electrode and the portion of the outer circumferential section where the line width is narrower.

For example, in the outer circumferential section of the coil, a portion adjacent to the end surface electrode is recessed toward the inside of the coil when viewed from above. This prevents the end surface electrode from making contact with the coil while decreasing a direct-current resistance component by widening, as much as possible, the line width of the coil as a whole. Further, because the non-magnetic paste is applied to the recessed portion, the non-magnetic body can be formed between the outer circumferential section of the coil and the end surface electrode without necessarily providing an additional portion for forming the non-magnetic body.

A mode in which the non-magnetic body layer is also disposed in an intermediate layer of the main body of the device may be employed.

According to the present disclosure, a delamination in which a coil pattern is peeled from ceramics after firing can be suppressed from occurring. Further, controlling the number of layers where non-magnetic paste is applied makes it possible to control magnetic resistance, whereby the direct-current superposition characteristics to serve as a coil can be controlled.

BRIEF DESCRIPTION OF THE SEVERAL VIEWS OF THE DRAWINGS

FIG. 1 is a view schematically illustrating a longitudinal cross-sectional structure of a DC-DC converter module equipped with a multilayer substrate.

Figure 1:
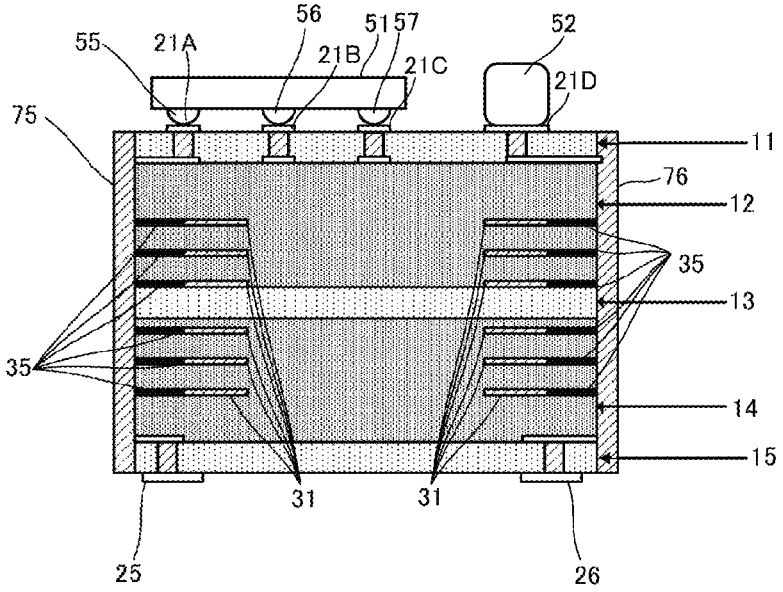
FIG. 1 is a longitudinal cross-sectional view of a DC-DC converter.

The multilayer substrate is formed of a multilayer body in which a plurality of ceramic green sheets are laminated. In the multilayer substrate, in the order from a front surface (upper surface) side toward a rear surface (lower surface) side of the outermost layer, sequentially disposed are a non-magnetic ferrite layer 11, a magnetic ferrite layer 12, a non-magnetic ferrite layer 13, a magnetic ferrite layer 14, and a non-magnetic ferrite layer 15.

Figure 2A:
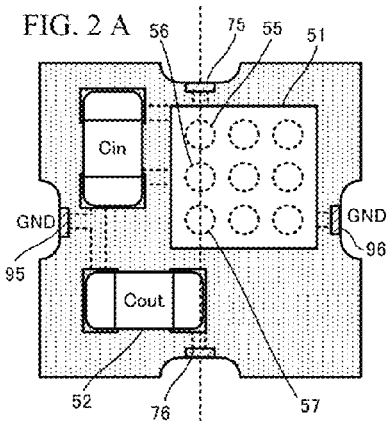
FIGS. 2A-2E include plan views of a DC-DC converter.
Figure 2B:
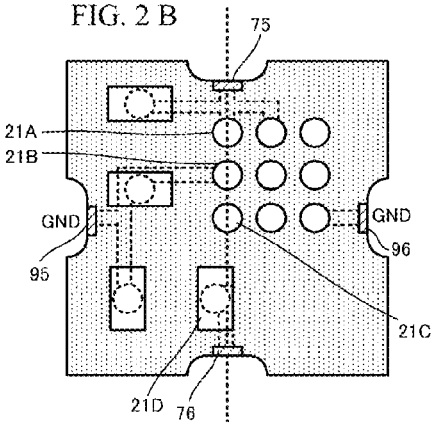
Figure 2C:
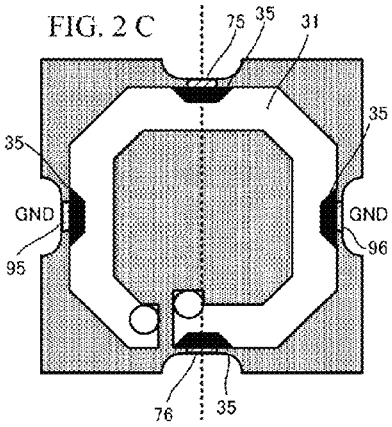
Figure 2D:
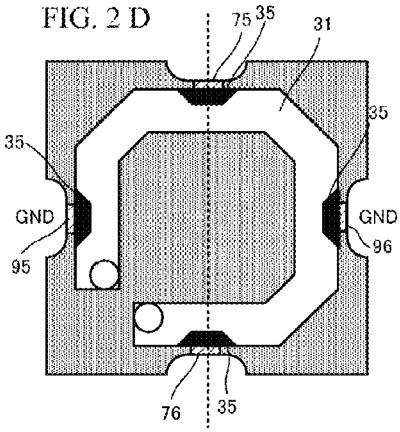
Figure 2E:
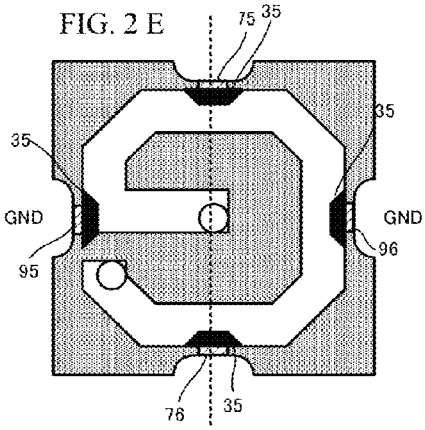

FIG. 2A is a plan view illustrating an uppermost surface (first layer) on which components of the DC-DC converter module are mounted, and FIG. 2B is a plan view illustrating the uppermost layer in the case where the mounted components are omitted. FIG. 2C is a plan view of a magnetic body substrate, included in the magnetic ferrite layer 12, in which a conductive pattern 31 is formed; FIG. 2D is a plan view of a magnetic body substrate disposed in a lower layer relative to the above magnetic body substrate; and FIG. 2E is a plan view of a magnetic body substrate disposed in a further lower layer relative thereto.

As shown in FIG. 1 and FIG. 2B, a plurality of electrodes for mounting a plurality of components are formed on the uppermost surface in the laminating direction of the multilayer substrate. In FIG. 1 and FIG. 2B, illustrated are an electrode 21A connected to an input terminal 55 of a control IC 51, an electrode 21B connected to a ground terminal 56 of the control IC 51, an electrode 21C connected to an output terminal 57 of the control IC 51, and an electrode 21D connected to a terminal of an output-side capacitor 52.

On a lowermost surface in the laminating direction of the multilayer substrate, there are formed various kinds of electrodes to be connected to land electrodes or the like provided on a side of a mounting substrate where the DC-DC converter is mounted. In FIG. 1, an input electrode 25 and an output electrode 26 are illustrated.

As shown in FIG. 1 and FIGS. 2A through 2E, an end surface electrode 75, an end surface electrode 76, an end surface electrode 95, and an end surface electrode 96 are respectively formed on end surfaces of the multilayer substrate.

As shown in FIG. 1 and FIG. 2B, the electrode 21A is electrically connected to the end surface electrode 75 through a via hole, an interconnection, and so on. The electrode 21B is electrically connected to the end surface electrode 95 through a via hole, an interconnection, and so on. The electrode 21D is electrically connected to the end surface electrode 76 through a via hole, an interconnection, and so on.

Further, as shown in FIG. 1, the end surface electrode 75 is electrically connected to the input electrode 25, and the end surface electrode 76 is electrically connected to the output electrode 26. With this, the electrode 21A is electrically connected to the input electrode 25. The electrode 21D is electrically connected to the output electrode 26. The end surface electrode 95 and the end surface electrode 96 connect various kinds of electrodes provided on the uppermost surface (for example, electrode 21B for component mounting) to ground electrodes (not shown) provided on the lowermost surface.

The conductive pattern 31 is interlayer-connected through via holes so as to be connected in a helical shape across the magnetic ferrite layer 12, the non-magnetic ferrite layer 13, and the magnetic ferrite layer 14. With this, a coil conductor is formed so that the multilayer substrate functions as an inductor and also functions as a DC-DC converter module by mounting electronic components such as the control IC 51, various types of capacitors, and the like thereupon.

For example, in the case of a stepdown DC-DC converter, the conductive pattern 31 is connected to the output terminal 57 of the control IC 51. The output side of the conductive pattern 31 is connected to the output-side capacitor 52; the output-side capacitor 52 and the output side of the conductive pattern 31 are connected to the output electrode 26 via various types of wiring such as the end surface electrode 76 and so on.

The non-magnetic ferrite layer 13 as an intermediate layer functions in a manner as to be magnetically equivalent to a case in which there exists a space between the magnetic ferrite layer 12 and the magnetic ferrite layer 14, so as to enhance the direct-current superposition characteristics to serve as an inductor. Note that, however, the non-magnetic ferrite layer 13 is optional.

The non-magnetic ferrite layer 11 and the non-magnetic ferrite layer 15 disposed in the outermost layer have functions to cover the upper surface side of the magnetic ferrite layer 12 and the lower surface side of the magnetic ferrite layer 14, respectively. Note that the non-magnetic ferrite layer 11 and the non-magnetic ferrite layer 15 are provided to enhance strength of the device as well. To be more specific, by sandwiching the magnetic ferrite layer 12 and magnetic ferrite layer 14 having a relatively high thermal shrinkage coefficient between the non-magnetic ferrite layer 11 and non-magnetic ferrite layer 15 having a relatively low thermal shrinkage coefficient, the overall device shrinks and the strength of the device is enhanced when experiencing firing.

As shown in FIGS. 2C through 2E, in the conductive pattern 31 of the present embodiment, portions of the outer circumferential section adjacent to the end surface electrode 75, the end surface electrode 76, the end surface electrode 95, and the end surface electrode 96 are respectively recessed toward the inside of the pattern when viewed from above. In other words, the line widths are narrower at the above portions. This makes it possible to prevent each end surface electrode from making contact with the conductive pattern 31 while lowering a direct-current resistance component of the conductive pattern 31 itself by widening, as much as possible, the line width of the conductive pattern 31 as a whole. Note that, however, narrowing the line width at a specific portion of the conductive pattern 31 as described above is optional.

Then, as shown in FIGS. 2C through 2E, non-magnetic paste 35 is formed between each end surface electrode and the outer circumferential section of the conductive pattern 31 at each of the portions where the line width is narrower.

As described thus far, in the multilayer substrate of the present embodiment, the non-magnetic paste 35 is formed in a space between the conductive pattern 31 and each of the end surface electrodes. With this, the portion where the non-magnetic paste 35 is formed has the same function as in a case where the non-magnetic ferrite layer 13 is inserted therein. Accordingly, the non-magnetic ferrite layer 13 can be omitted or the number of layers included in the non-magnetic ferrite layer can be lessened, whereby reduction in height of the multilayer substrate can be realized. In addition, the direct-current superposition characteristics can be enhanced without necessarily providing an additional non-magnetic ferrite substrate.

Note that the non-magnetic paste 35 need not be formed in all layers in the conductive pattern 31. Specifically, because changing the number of layers in which the non-magnetic paste 35 is formed can change the magnetic resistance, the direct-current superposition characteristics to serve as an inductor can be controlled without necessarily changing the thickness.

Further, because the non-magnetic paste 35 removes a step existing in an area between the outer circumferential section of the conductive pattern 31 and the end surface electrode, pressure is applied to the above area when performing pressure bonding, thereby making it possible to suppress the occurrence of delamination.

The non-magnetic paste 35 need not be in contact with the end surface electrode, and a slight space may be present between them. Specifically, at a time of manufacturing the multilayer substrate, when the non-magnetic paste 35 is printed having a space with respect to the end surface electrode, the non-magnetic paste 35 comes so close as to be almost in contact with the end surface electrode or actually makes contact therewith due to bleeding during the printing.

Next, a manufacturing method of the multilayer substrate will be described. FIG. 3 includes diagrams illustrating a manufacturing process of the multilayer substrate, specifically a manufacturing process of a magnetic body substrate.

Figure 3A:
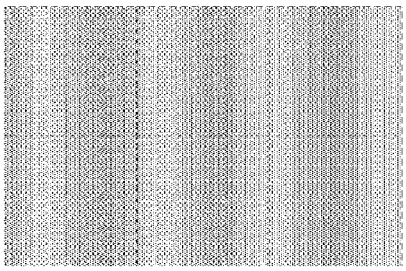
FIGS. 3A-3F include diagrams illustrating a magnetic body substrate manufacturing process.

First, as shown in FIG. 3A, a plurality of magnetic body substrate ceramic green sheets (mother sheets) are prepared. Next, as shown in FIG. 3B, rectangular holes are provided by punching or the like at the positions where end surfaces of each multilayer substrate will be formed after individualization.

Figure 3B:
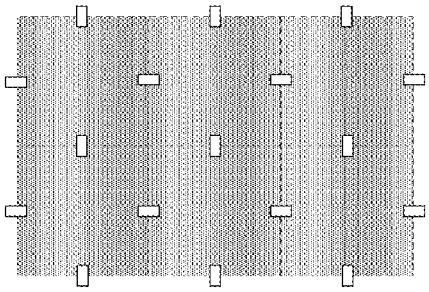
Figure 3C:
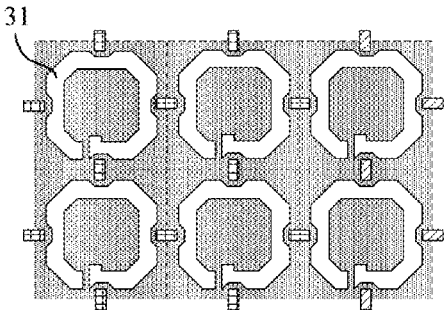

Subsequently, as shown in FIG. 3C, the holes provided in the process described in FIG. 3B are filled with conductive material, and interconnections (conductive pattern 31) are formed.

Figure 3D:
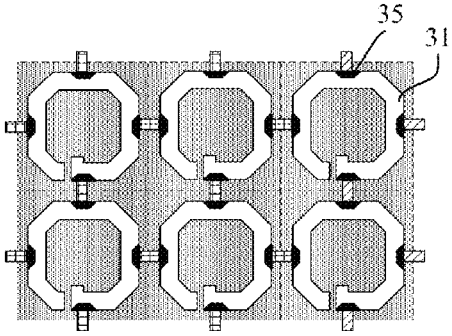

Thereafter, as shown in FIG. 3D, the non-magnetic paste 35 is formed by printing between the outer circumferential section of each conductive pattern and the end surface electrodes. In the present embodiment, although an example in which portions recessed toward the inside of the conductive pattern 31 are filled with the non-magnetic paste 35 is cited, the recessed portions need not be fully filled with the paste. For example, as described before, the non-magnetic paste 35 may be printed having a space with respect to the end surface electrode.

Figure 3E:
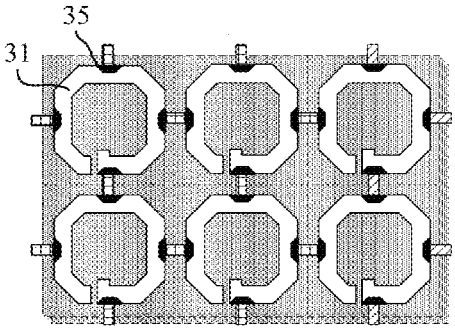

Then, as shown in FIG. 3E, the plurality of magnetic body substrates are laminated and pressure-bonded. At this time, although not illustrated, the non-magnetic body substrates are disposed in the outermost layer and the internal layer. With this, a mother multilayer body is obtained.

Figure 3F:
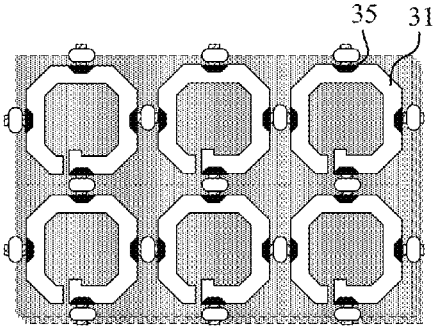

Finally, as shown in FIG. 3F, additionally provided are rectangular holes, by punching or the like, facing a different direction from (a direction orthogonal to) the direction of the holes previously provided as described in FIG. 3B. Note that the shape of the holes provided through the processing shown in FIG. 3B and the shape of the holes provided through the processing shown in FIG. 3F are not limited to a rectangle, and may take any shape such as an oval, a circle, or the like.

With this, the rectangular holes provided through the processing shown in FIG. 3F become through-holes, while the rectangular holes provided through the processing shown in FIG. 3B (holes filled with conductive material) become end surface electrodes.

Then, by firing the mother multilayer body and breaking it later, the multilayer substrate according to the present disclosure is obtained.

REFERENCE SIGNS LIST

11, 13, 15 non-magnetic ferrite layer
12, 14 magnetic ferrite layer
21A, 21B, 21C, 21D electrode
25 input electrode
26 output electrode
31 conductive pattern
35 non-magnetic paste
75, 76, 95, 96 end surface electrode

The invention claimed is:

1. An inductance device comprising:

a magnetic body layer comprising a plurality of magnetic body substrates being laminated;

a non-magnetic body layer comprising a plurality of non-magnetic body substrates being laminated and disposed in an outermost layer of a main body of the device;

an inductor in which a coil provided among the laminated substrates is connected in a laminating direction; and a non-magnetic body located between an end surface electrode provided on an end surface of the main body of the device and an outer circumferential section of the coil in the magnetic body layer, wherein the outer circumferential section of the coil that faces the non-magnetic body extends in a same vertical cross-sectional direction as the end surface electrode, wherein a line width of a portion of the coil adjacent to the end surface electrode is narrower than a line width of another portion of the coil, and the non-magnetic body is located between the end surface electrode and the portion of the outer circumferential section where the line width is narrower.

2. The inductance device according claim 1, wherein the non-magnetic body layer is also disposed in an intermediate layer of the main body of the device.

3. The inductance device according to claim 1, wherein the non-magnetic body is spaced apart from the end surface electrode.

4. The inductance device according claim 1, wherein the non-magnetic body layer is also disposed in an intermediate layer of the main body of the device.

5. The inductance device according claim 1, wherein the non-magnetic body is provided between the end surface electrode and a portion of the outer circumferential section of the coil recessed toward an inside of the coil when viewed from above.

6. The inductance device according claim 1, wherein the end surface electrode is provided on an end surface of the main body of the device across the laminating direction of the laminated substrates.

* * * * *